US009773446B2

(12) United States Patent
Yao et al.

(10) Patent No.: US 9,773,446 B2
(45) Date of Patent: Sep. 26, 2017

(54) DISPLAY ACTIVATION AND DEACTIVATION CONTROL

(71) Applicant: APPLE INC., Cupertino, CA (US)

(72) Inventors: Wei H. Yao, Palo Alto, CA (US); Yafei Bi, Palo Alto, CA (US); Ahmad Al-Dahle, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 151 days.

(21) Appl. No.: 14/106,384

(22) Filed: Dec. 13, 2013

(65) Prior Publication Data

US 2014/0168292 A1 Jun. 19, 2014

Related U.S. Application Data

(60) Provisional application No. 61/737,584, filed on Dec. 14, 2012.

(51) Int. Cl.

| | |
|---|---|
| ***G09G 5/02*** | (2006.01) |
| ***G09G 3/3208*** | (2016.01) |
| ***G09G 5/00*** | (2006.01) |

(52) U.S. Cl.

CPC ..... *G09G 3/3208* (2013.01); *G09G 5/003* (2013.01); *G09G 2300/0861* (2013.01); *G09G 2360/144* (2013.01)

(58) Field of Classification Search

None

See application file for complete search history.

(56) References Cited

U.S. PATENT DOCUMENTS

| | | | | |
|---|---|---|---|---|
| 5,907,314 | A * | 5/1999 | Negishi | G09G 3/3614 345/100 |
| 6,278,242 | B1 | 8/2001 | Cok et al. | |
| 7,595,786 | B2 * | 9/2009 | Shih | G01J 1/1626 315/149 |
| 7,868,805 | B2 | 1/2011 | Choi | |
| 2009/0244050 | A1 * | 10/2009 | Yamamoto et al. | 345/212 |
| 2009/0322724 | A1 | 12/2009 | Smith | |
| 2011/0080441 | A1 | 4/2011 | Wacyk et al. | |
| 2011/0130981 | A1 | 6/2011 | Chaji et al. | |
| 2012/0139820 | A1 * | 6/2012 | Senda et al. | 345/76 |
| 2012/0169574 | A1 * | 7/2012 | Kim | 345/76 |
| 2012/0188291 | A1 * | 7/2012 | Kobayashi | G09G 3/3233 345/690 |
| 2014/0132158 | A1 * | 5/2014 | Land | G09G 3/20 315/152 |

* cited by examiner

*Primary Examiner* — William Boddie
*Assistant Examiner* — Alecia D English
(74) *Attorney, Agent, or Firm* — Fletcher Yoder PC

(57) ABSTRACT

An electronic display includes a display panel, which includes an array of pixels and a driver configured to activate and deactivate the emission of light from each of the pixels in the array. The electronic display also includes a panel driver configured to generate and transmit an emission interrupt signal to the driver, wherein the emission interrupt signal causes the driver to deactivate the emission of light from all pixels in the array for a set period of time prior to a refresh of a line of pixels in the array.

5 Claims, 6 Drawing Sheets

DISPLAY ACTIVATION AND DEACTIVATION CONTROL

CROSS REFERENCE TO RELATED APPLICATIONS

This application is a Non-Provisional Application of U.S. Provisional Patent Application No. 61/737,584, entitled "Display Activation and Deactivation Control", filed Dec. 14, 2012, which is herein incorporated by reference.

BACKGROUND

The present disclosure relates generally to displays for electronic devices and, more specifically, to controlling the activation and deactivation of a display in a set manner.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Organic light emitting diode (OLED) displays are self-emissive, in that the amount of light emitted from any subpixel in the displays depend on an amount of current passing through a light emitting diode in that subpixel. As a result, OLED displays work without a backlight, which allow them to display deep black levels, high contrast, and bright colors. Further, OLED displays have fast response times and result in displays that are thinner and lighter than a liquid crystal display (LCD).

However, it may not be advantageous to have OLED displays constantly "on" (i.e., emitting light). For example, it may be beneficial for a device that utilizes an OLED display to also incorporate an ambient light sensor to determine ambient light around a device. Accurate measurements of ambient light levels may be hindered if taken while the OLED display is emitting light. Additionally, an electronic device utilizing an OLED display may include touch sensing capabilities. For accurate measurements of touch, it may be beneficial for the OLED display to be "off" (i.e., not emitting light) while touch inputs are being received by the device, for example, to reduce noise that may be caused from the operation of the circuitry of the OLED display. Accordingly, as situations occur in which deactivation of the OLED display would be beneficial, it would be advantageous to have the ability to actively control when an OLED device is to be deactivated without impacting user experience (e.g., generating visible artifacts).

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to control of the operation of an OLED display. The OLED display may be activated and deactivated at set instances. This activation and deactivation may be accomplished at rates sufficient to reduce and/or eliminate visual artifacts on the OLED display. In one embodiment, driving circuitry of the OLED display may split into two or more elements. During a period of time between one of the driving circuits operating and another driving circuit operating, the OLED may cease to emit light. Thus, based on the number and size of the driving circuitry, times when the OLED is not emitting light may be generated. In another embodiment, driving signals utilized by the driving circuitry to activate lines of the OLED may be altered such that signals may be intermittently added to the driving signals that cause the OLED to cease to emit light. Furthermore, notification of this instances when light emission from the OLED is halted may be communicated to other elements of an electronic device.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure are directed to the control of a display. This display may be an OLED display that may be activated and deactivated at set instances. In one embodiment, the activation and deactivation schedule may be determined by hardware characteristics of the OLED display. In another embodiment, the activation and deactivation of the OLED display may be accomplished at scheduled times, which may be altered, or by request from a component of the device in which the OLED display is present.

Figure 1:
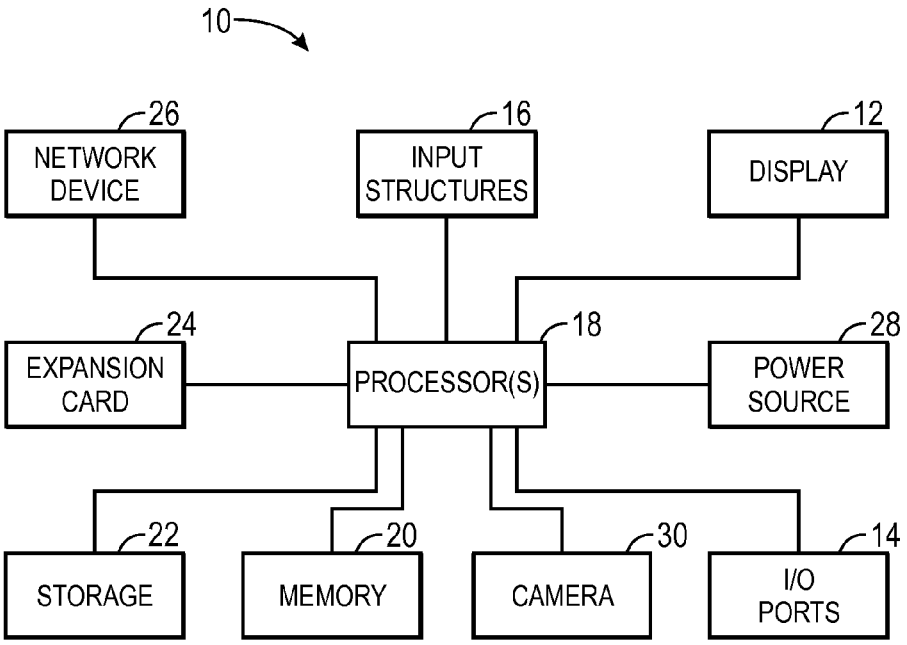
FIG. 1 is a block diagram of components of an electronic device, in accordance with aspects of the present disclosure.

As may be appreciated, electronic devices may include various internal and/or external components which contribute to the function of the device. For instance, FIG. 1 is a block diagram illustrating components that may be present in one such electronic device 10. Those of ordinary skill in the art will appreciate that the various functional blocks shown in FIG. 1 may include hardware elements (including circuitry), software elements (including computer code stored on a computer-readable medium, such as a hard drive or system memory), or a combination of both hardware and software elements. FIG. 1 is only one example of a particular implementation and is merely intended to illustrate the types of components that may be present in the electronic device 10. For example, in the presently illustrated embodiment, these components may include a display 12, input/output (I/O) ports 14, input structures 16, one or more processors 18, one or more memory devices 20, nonvolatile storage 22, expansion card(s) 24, networking device 26, power source 28, and a camera.

The display 12 of the electronic device 10 may be used to display various images generated by the electronic device 10. The display 12 may be any suitable display, such as a liquid crystal display (LCD) or an organic light-emitting diode (OLED) display. Additionally, in certain embodiments of the electronic device 10, the display 12 may be provided in conjunction with a touch-sensitive element, such as a touchscreen, that may be used as part of the control interface for the device 10. The display 12 may include a number of pixels or picture elements that may be used to depict images on the display 12, whereby each pixel may be composed of three pixel components, known as subpixels, which may depict red, green, and blue colors, respectively. Alternatively, four pixel components, namely red, green, blue, and white may be employed. In the case of the display 12 being an OLED display, each subpixel may depict its respective color using an emissive electroluminescent layer (i.e., film of organic compound), which emits light in response to an electric current. The color of the light viewed may be the light emitted directly by the OLED subpixels, or the color altered by passage through a color filter containing an absorbing or a fluorescing material.

The I/O ports 14 of the electronic device 10 may include ports configured to connect to a variety of external devices, such as an external power source, a headset or headphones, or other electronic devices (such as handheld devices and/or computers, printers, projectors, external displays, modems, docking stations, and so forth). The I/O ports 14 may support any interface type, such as a universal serial bus (USB) port, a video port, a serial connection port, an IEEE-1394 port, a speaker, an Ethernet or modem port, a lightning connection port, and/or an AC/DC power connection port.

The input structures 16 may include the various devices, circuitry, and pathways by which user input or feedback is provided to processor(s) 18. Such input structures 16 may be configured to control a function of an electronic device 10, applications running on the device 10, and/or any interfaces or devices connected to or used by device 10. For example, input structures 16 may allow a user to navigate a displayed user interface or application interface. Non-limiting examples of input structures 16 include buttons, sliders, switches, control pads, keys, knobs, scroll wheels, keyboards, mice, touchpads, microphones, and so forth. Additionally, in certain embodiments, one or more input structures 16 may be provided together with display 12, such an in the case of a touchscreen, in which a touch sensitive mechanism is provided in conjunction with display 12.

Processors 18 may provide the processing capability to execute the operating system, programs, user and application interfaces, and any other functions of the electronic device 10. The processors 18 may include one or more microprocessors, such as one or more "general-purpose" microprocessors, one or more special-purpose microprocessors or ASICS, or some combination of such processing components. For example, the processors 18 may include one or more reduced instruction set (RISC) processors, as well as graphics processors, video processors, audio processors, and the like. As will be appreciated, the processors 18 may be communicatively coupled to one or more data buses or chipsets for transferring data and instructions between various components of the electronic device 10.

Programs or instructions executed by processor(s) 18 may be stored in any suitable manufacture that includes one or more tangible, computer-readable media at least collectively storing the executed instructions or routines, such as, but not limited to, the memory devices and storage devices described below. Also, these programs (e.g., an operating system) encoded on such a computer program product may also include instructions that may be executed by the processors 18 to allow device 10 to provide various functionalities, including those described herein.

The instructions or data to be processed by the one or more processors 18 may be stored in a computer-readable medium, such as a memory 20. The memory 20 may include a volatile memory, such as random access memory (RAM), and/or a non-volatile memory, such as read-only memory (ROM). The memory 20 may store a variety of information and may be used for various purposes. For example, the memory 20 may store firmware for electronic device 10 (such as basic input/output system (BIOS)), an operating system, and various other programs, applications, or routines that may be executed on electronic device 10. In addition, the memory 20 may be used for buffering or caching during operation of the electronic device 10.

The components of the device 10 may further include other forms of computer-readable media, such as non-volatile storage 22 for persistent storage of data and/or instructions. Non-volatile storage 22 may include, for example, flash memory, a hard drive, or any other optical, magnetic, and/or solid-state storage media. Non-volatile storage 22 may be used to store firmware, data files, software programs, wireless connection information, and any other suitable data.

The embodiment illustrated in FIG. 1 may also include one or more card or expansion slots. The card slots may be configured to receive one or more expansion cards 24 that may be used to add functionality, such as additional memory, I/O functionality, or networking capability, to electronic device 10. Such expansion cards 24 may connect to device 10 through any type of suitable connector, and may be accessed internally or external to the housing of electronic device 10. For example, in one embodiment, expansion cards 24 may include a flash memory card, such as a SecureDigital (SD) card, mini- or microSD, CompactFlash card, Multimedia card (MMC), or the like. Additionally, expansion cards 24 may include one or more processor(s) 18 of the device 10, such as a video graphics card having a GPU for facilitating graphical rendering by device 10.

The components depicted in FIG. 1 also include a network device 26, such as a network controller or a network interface card (NIC). In one embodiment, the network device 26 may be a wireless NIC device providing wireless connectivity over any 802.11 standard or any other suitable wireless networking standard, a radio frequency device, a Bluetooth® device, a cellular communication device, or the like. The network device 26 may allow the electronic device 10 to communicate over a network, such as a Local Area Network (LAN), Wide Area Network (WAN), or the Internet. The device 10 may also include a power source 28. In one embodiment, the power source 28 may include one or more batteries, such as a lithium-ion polymer battery or other type of suitable battery. Additionally, the power source 28 may include AC power, such as provided by an electrical outlet, and electronic device 10 may be connected to the power source 28 via a power adapter. This power adapter may also be used to recharge one or more batteries of device 10. The electronic device 10 may also include a camera 30 that may be utilized to capture digital images and video. In one embodiment, the camera 30 may also be utilized for detecting ambient light in addition to capturing digital images or video.

Figure 2:
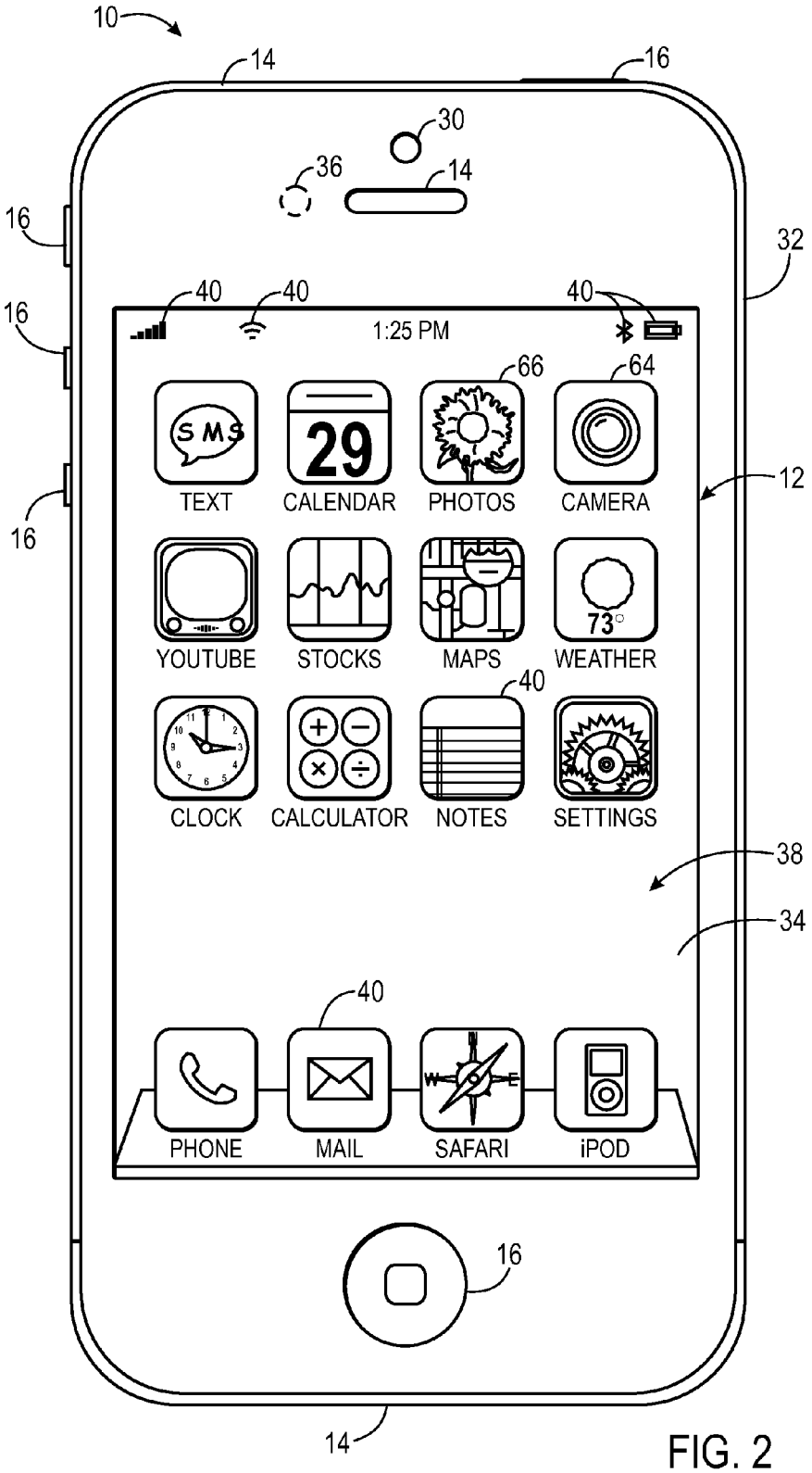
FIG. 2 is a front view of a handheld electronic device, in accordance with aspects of the present disclosure.
Figure 3:
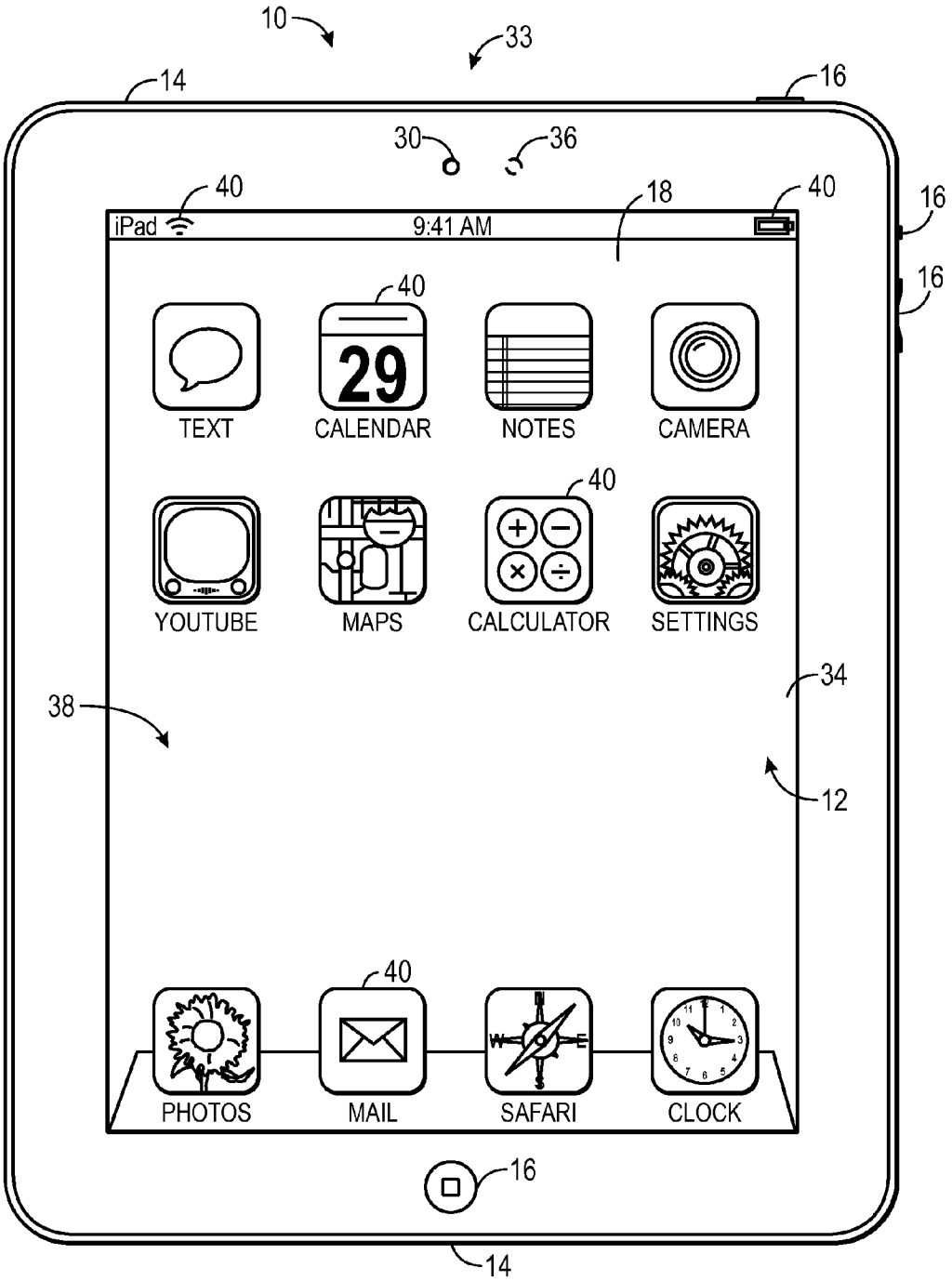
FIG. 3 is a front view of a second electronic device, in accordance with aspects of the present disclosure.

With the foregoing in mind, FIG. 2 illustrates an electronic device 10 in the form of a handheld device, here a cellular device 32 (such as a model of an iPhone®), that includes various functionalities (such as the ability to take pictures, make telephone calls, access the Internet, communicate via email, record audio and video, listen to music, play games, and connect to wireless networks). Alternatively, the electronic device 10 may also take the form of other types of electronic devices, such as media players, tablets, personal data organizers, handheld game platforms, cameras, and combinations of such devices. For instance, as generally depicted in FIG. 3, the electronic device 10 may be provided in the form of a handheld electronic device 33. By way of further example, handheld device 33 may be a model of an iPod® or iPad® available from Apple Inc. of Cupertino, Calif.

As illustrated in both FIGS. 2 and 3, electronic device 10 includes a display 12, which may be in the form of an OLED display 34, as well as an ambient light sensor 36. The ambient light sensor 36 may include one or more photosensors, such as photodetectors, photo diodes, photo resistors, photocells, or any other sensor capable of detecting ambient light or other electromagnetic energy surrounding the electronic device 10. In certain embodiments, the camera 30 may serve as a light sensor in place of or in addition to the ambient light sensor 36.

The OLED display 34 may display various images generated by electronic device 10, such as a graphical user interface (GUI) 38 having one or more icons 40. The GUI 38 allows a user to interact with the cellular device 32 and the handheld device 33. The cellular device 32 and the handheld device 33 may also each include various input and output (I/O) ports 14 that allow connection of the device 10 to external devices, such as a port that allows the transmission and reception of data or commands between the electronic device 10 and another electronic device. The device 10 may also include user input structures 16 to facilitate interaction with a user and allow for starting, controlling, or operating the GUI 38 or applications running on the device 10.

Figure 4:
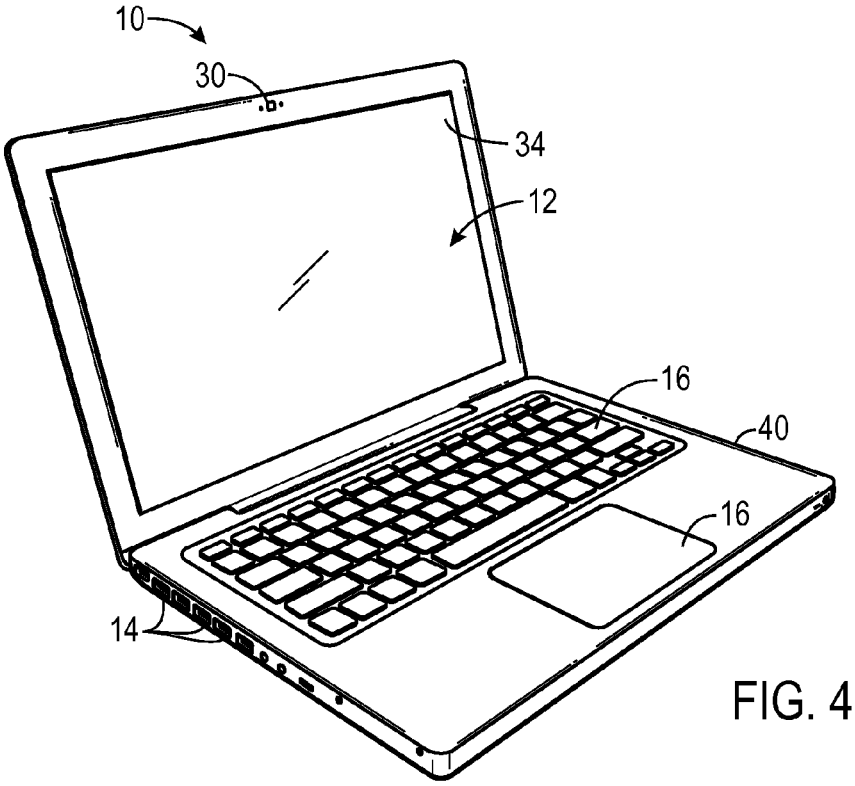
FIG. 4 is a view of a computer, in accordance with aspects of the present disclosure.

In addition to the cellular device 32 of FIG. 2 and the handheld device 33 of FIG. 3, the electronic device 10 may also take the form of a computer or other type of electronic device. Such computers may include computers that are generally portable (such as laptop, notebook, and tablet computers) as well as computers that are generally used in one place (such as conventional desktop computers, workstations, and/or servers). In certain embodiments, the electronic device 10 in the form of a computer may be a model of a MacBook®, MacBook® Pro, MacBook Air®, iMac®, Mac® mini, iPad® or Mac Pro® available from Apple Inc. By way of example, an electronic device 10 in the form of a laptop computer 40 is illustrated in FIG. 4 in accordance with one embodiment. The depicted computer 40 includes, a display 12 (such as an OLED display 34), input/output ports 14, and input structures 16.

In one embodiment, the input structures 16 (such as a keyboard and/or touchpad) may be used to interact with the computer 40, such as to start, control, or operate a GUI or applications running on the computer 40. For example, a keyboard and/or touchpad may allow a user to navigate a user interface or application interface displayed on the display 12.

As depicted, the electronic device 10 in the form of computer 40 may also include various input and output ports 14 to allow connection of additional devices. For example, the computer 40 may include an I/O port 14, such as a USB port or other port, suitable for connecting to another electronic device, a projector, a supplemental display, and so forth. In addition, the computer 40 may include network connectivity, memory, and storage capabilities, as described with respect to FIG. 1. As a result, the computer 40 may store and execute a GUI and other applications.

Figure 5:
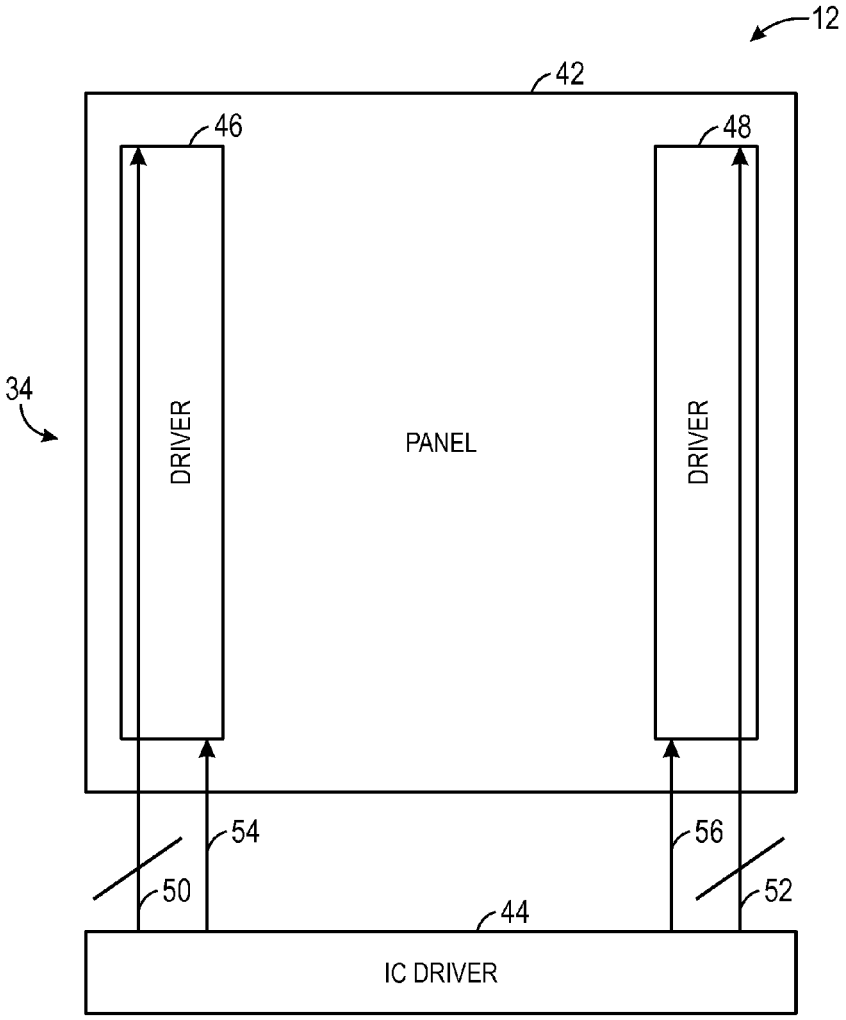
FIG. 5 graphically depicts circuitry that may be found in the electronic device of FIG. 1, in accordance with aspects of the present disclosure.

With the foregoing discussion in mind, it may be appreciated that an electronic device 10 in the form of a cellular device 32, a handheld device 33, or a computer 40, may be provided with an OLED display 34 as the display 12. Such an OLED display 34 may be utilized to display the respective operating system and application interfaces running on the electronic device 10 and/or to display data, images, or other visual outputs associated with an operation of the electronic device 10. FIG. 5 illustrates one embodiment of the OLED display 34 that may be utilized as the display 12 in conjunction with the electronic device 10.

FIG. 5 illustrates display 12 and, more particularly, OLED display 34. OLED display 34 may include a panel 42, an integrated circuit (IC) driver 44, sampling driver circuitry 46, and emission driver circuitry 48. The panel 42 may include a number of pixels (e.g., an array of pixels) or picture elements that may be used to depict images on the OLED display 34, whereby each pixel may be composed of three pixel components, known as subpixels, which may depict red, green, and blue colors, respectively. Alternatively, four pixel components, namely red, green, blue, and white may be employed in the pixels of the panel 42. Furthermore, each subpixel of the OLED display 34 may depict its respective color using an emissive electroluminescent layer (i.e., film of organic compound), which emits light in response to an electric current. Additionally, the color of the light viewable by a user may be the light emitted directly by the OLED subpixels, or the color altered by passage through a color filter containing an absorbing or a fluorescing material.

As noted above, the OLED display 34 may also include also include an IC driver 44. The IC driver 44 may be a display driver, which provides signals to the display panel 42 to generate images therein. Additionally, power signals may be transmitted from the IC driver 44 to the display panel 42. The IC driver 44 may be internal to the display 12 and coupled to other components of the electronic device 10 (e.g., processor(s) 18) via an electrical connection, for example, a flex circuit coupled to a common board with at least some of the other components of the electronic device 10 or other connection type. The IC driver 44 may receive signals from, for example, processor(s) 18 indicative of images to be displayed on the OLED display 34. The IC driver 44 may process these received signals (e.g., buffer, modify, group, rearrange, etc.) and may generate output signals to be transmitted to the panel 42. Specifically, the IC driver 44 may generate clocking signals for transmission along paths 50 and 52 (which may each include multiple individual lines), scanning signals for transmission along path 54, and emission signals for transmission along path 56. These signals generated by the IC driver 44 may be utilized by the panel 42, specifically by the sampling driver circuitry 46 and emission driver circuitry 48 to generate images on the OLED display 34.

It may be appreciated that the sampling driver circuitry 46 and the emission driver circuitry 48 are illustrated as separate from the IC driver 44. However, in some embodiments, the sampling driver circuitry 46 and the emission driver circuitry 48 may be integrated into the IC driver 44, for example, as a-Si driver circuits in the IC driver 44, such that the IC driver 44 will transmit any gate control signals, panel driver output signals, and emission interrupt signals.

In one embodiment, the sampling driver circuitry 46 may receive clocking signals along path 50 as well as scanning signals along path 54 from IC driver 44. The clocking signals may be utilized by the sampling driver circuitry 46 to clock data into lines of the panel 42 (e.g., to toggle data values into the pixels of the panel 42). The data values themselves, as well as an initialization (start signal) for the driving of the data to the pixels, may be provided from the driver IC 44 to the sampling driver circuitry 46 along path 54. These data values provided by the driver IC may correspond to pixel intensities for individual pixels for a given frame (e.g., the intensities the pixels in a given frame should be driven to generate a particular image). The sampling driver circuitry 46 may utilize the data values, clock signals, and initialization information provided by the IC driver 44 to transmit pixel data corresponding to desired pixel intensities to the pixels of the panel 42 in a line by line manner, for example, vertically across each line of pixels of the panel 42 for a particular frame.

The emission driver circuitry 48 may receive clocking signals along path 52 as well as emission signals along path 56 from IC driver 44. The clocking signals may be utilized by the emission driver circuitry 48 to clock emission signals into lines of the panel 42 (e.g., to allow the pixels of the panel 42 to emit light once the data values have been read into the pixels of the panel 42). The emission signals themselves, as well as an initialization (start signal) for the driving of the emission signals to the pixels, may be provided from the IC driver 44 to the emission driver circuitry 48 along path 56. These emission signals provided by the IC driver 44 may correspond to signals that activate individual pixels for a given frame (e.g., allow the pixels to begin to emanate light in a given frame to generate a particular image). Moreover, the emission driver circuitry 48 may utilize the emission signals, clock signals, and initialization information provided by the IC driver 44 to allow pixels of the panel 42 to emanate once data is received at the pixels in a line by line manner, for example, vertically across each line of pixels of the panel 42 for a particular frame.

In this manner, the OLED display 34 may display an image for a period of time, e.g., a frame. In some embodiments, 30 frames of data may be displayed on the OLED display 34 every second. That is, updated data (altered from previous data if an image to be displayed is to be different from an image currently being displayed and identical to previous data if an image to be displayed is to be the same as an image currently being displayed) may be transmitted to the panel 42 from the driver IC 44 to allow for a new frame to be displayed, for example, every $1/30^{th}$ of a second.

Figure 6:
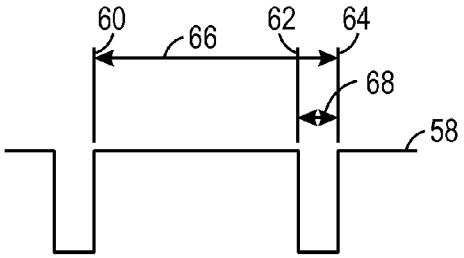
FIG. 6 depicts a timing diagram for the operation of the circuitry of FIG. 5, in accordance with aspects of the present disclosure.

Additionally, image being displayed on the panel 42 may be refreshed for each frame displayed on the OLED display 34 at a given refresh rate. This refresh rate may correspond to complete reconstruction of a given frame of data in a period of time. Typical refresh rates may include 30 Hz and 60 Hz (i.e., reconstructing a frame thirty times a second or sixty times a second). Thus, for example, if the frame rate of a display 12 is 30 frames per second and the refresh rate of the display 12 is 60 Hz, each frame of data will be repeated two times every $1/30^{th}$ of a second (generated once and refreshed once). Alternatively, for example, if the frame rate of a display 12 is 24 frames per second and the refresh rate of the display 12 is 120 Hz, each frame of data will be repeated five times every $1/24^{th}$ of a second (generated once and refreshed four times). FIG. 6 illustrates a timing diagram illustrating this refresh concept.

FIG. 6 illustrates a timing diagram for the refresh of a line of pixels for the OLED display 34 of FIG. 5. As illustrated, a vertical sync signal 58 that illustrates the synchronization of the frame rate and refresh rate of the display 12 discussed above, may rise to a "high" or one value at a first time 60, may drop to a "low" or zero value at a second time 62 and may rise to a "high" or one value at a third time 64. The time 66 between first time 60 and third time 64 may be equal to a single refresh of the display 12. For example, the time 66 between first time 60 and third time 64 may be 16.6 ms, which corresponds to a 60 Hz refresh rate for display 12. Additionally, in some embodiments, the time 68 between second time 62 and third time 64 may correspond to, for example, the time during a line of pixels is receiving data to be emitted and, thus, no emission is occurring during this time 68.

As previously discussed, there are times when it would be beneficial for an OLED display 34 to have all pixels off (i.e., not emanating light). For example, having all pixels off may allow for more accurate measurements of ambient light levels by the ambient light sensor 36 and/or may allow for greater accuracy in measuring/receiving touch inputs from a user. Accordingly, in one embodiment, the OLED display 34 may be altered as illustrated in FIG. 7.

Figure 7:
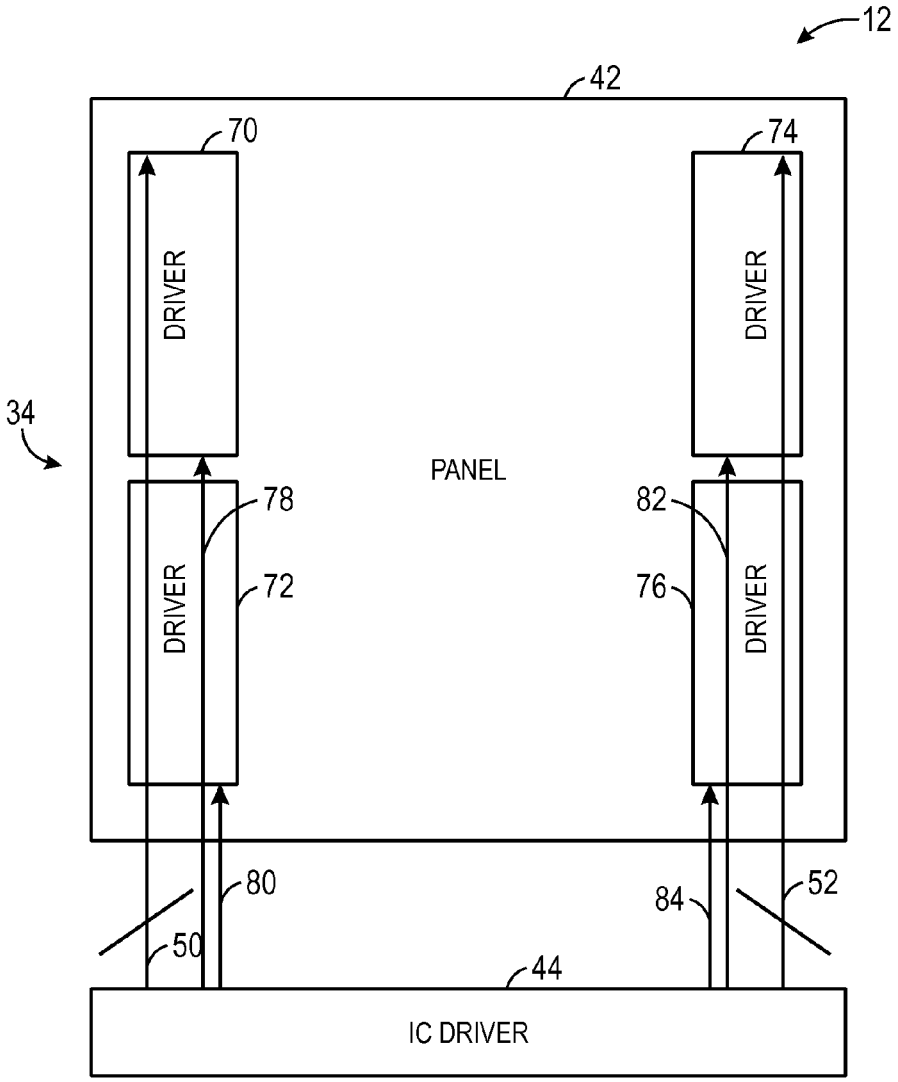
FIG. 7 graphically depicts a second embodiment of circuitry that may be found in the electronic device of FIG. 1, in accordance with aspects of the present disclosure.

FIG. 7 illustrates display 12 and, more particularly, another embodiment of OLED display 34. OLED display 34 may include a panel 42, an integrated circuit (IC) driver 44, and paths 50 and 52 as previously illustrated in FIG. 5. However, in place of sampling driver circuitry 46, emission driver circuitry 48, path 54, and path 56, the OLED display 34 of FIG. 7 includes first sampling driver circuitry 70, second sampling driver circuitry 72, first emission driver circuitry 74, second sampling driver circuitry 76, and paths 78, 80, 82, and 84. Again, it may be appreciated that while the first sampling driver circuitry 70, second sampling driver circuitry 72, first emission driver circuitry 74, and second sampling driver circuitry 76 are illustrated as separate from the IC driver 44, in some embodiments, the first sampling driver circuitry 70, second sampling driver circuitry 72, first emission driver circuitry 74, and second sampling driver circuitry 76 may be integrated into the IC driver 44, for example, as a-Si driver circuits in the IC driver 44, such that the IC driver 44 will transmit any gate control signals, panel driver output signals, and emission interrupt signals.

First sampling driver circuitry 70 and second sampling driver circuitry 72 may be functionally equivalent to sampling driver circuitry 46 except that each of the first sampling driver circuitry 70 and the second sampling driver circuitry 72 drive a portion of the total number of pixel lines in the panel 42. For example, first sampling driver circuitry 70 may drive the top half of the pixel lines of the panel 42 while second sampling driver circuitry 72 may drive the bottom half of the pixel lines of the panel 42. Additionally, while a first sampling driver circuitry 70 and a second sampling driver circuitry 72 are illustrated, three, four, five, or more sampling driver circuitry elements may be utilized in place of sampling driver circuitry 46. Furthermore, while first sampling driver circuitry 70 and second sampling driver circuitry 72 are illustrated as each corresponding to driving half of the pixel lines of panel 42, first sampling driver circuitry 70 may drive more or less pixel lines than second sampling driver circuitry 72 instead of an equal number of pixel lines. Additionally, where three or more sampling driver circuitry elements are utilized in place of sampling driver circuitry 46, each of the sampling driver circuitry elements may drive an equal number of pixel lines of panel 42, an different number of pixel lines of panel 42 from one another, or a combination thereof (e.g., two sampling driver circuitry elements drive the same number of pixel lines while a third sampling driver circuitry element drives a number of pixel elements that differs from the two sampling driver circuitry elements).

Likewise, first emission driver circuitry 74 and second sampling driver circuitry 76 may be functionally equivalent to emission driver circuitry 48 except that each of the first emission driver circuitry 74 and the second emission driver circuitry 76 operate to allow a portion of the total number of pixel lines in the panel 42 to emanate at a given time. For example, first emission driver circuitry 74 may be utilized in conjunction with the top half of the pixel lines of the panel 42 while second emission driver circuitry 76 may be utilized in conjunction with the bottom half of the pixel lines of the panel 42. Additionally, while a first emission driver circuitry 74 and a second emission driver circuitry 76 are illustrated, three, four, five, or more emission driver circuitry elements may be utilized in place of emission driver circuitry 48. Furthermore, while first emission driver circuitry 74 and second emission driver circuitry 76 are illustrated as each corresponding to half of the pixel lines of panel 42, first emission driver circuitry 74 may be associated with more or less pixel lines than second emission driver circuitry 76 instead of an equal number of pixel lines. Additionally, where three or more emission driver circuitry elements are utilized in place of emission driver circuitry 48, each of the emission driver circuitry elements may be associated with an equal number of pixel lines of panel 42, an different number of pixel lines of panel 42 from one another, or a combination thereof (e.g., two emission driver circuitry elements are associated with and provide signals to the same number of pixel lines while a third emission driver circuitry element is associated with and provides signals to a number of pixel elements that differs from the two emission driver circuitry elements).

Figure 8:
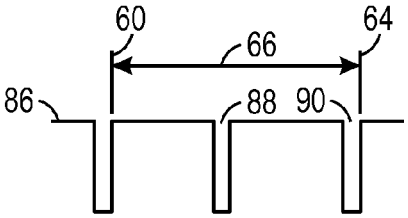
FIG. 8 depicts a timing diagram for the operation of the second embodiment of circuitry of FIG. 7, in accordance with aspects of the present disclosure.

Similarly, instead utilizing path 54, the IC driver 44 may generate scanning signals for transmission along paths 78 and 80 to each of the sampling driver circuitry 70 and 72, respectively. Likewise, instead utilizing path 56, e IC driver 44 may generate emission signals for transmission along paths 82 and 84 to each of the emission driver circuitry 74 and 76, respectively. These signals generated by the IC driver 44 may be utilized by the panel 42, specifically by the sampling driver circuitry 70 and 72 or emission driver circuitry 74 and 76, respectively, to generate images on the OLED display 34 in a manner similar to that described above with respect to FIG. 5. FIG. 8 illustrates a timing diagram that illustrates the refresh of the OLED display 34 of FIG. 7.

FIG. 8 illustrates a timing diagram for the refresh of a line of pixels for the OLED display 34 of FIG. 7. As illustrated, a vertical sync signal 86 that illustrates the synchronization of the frame rate and refresh rate of the display 12 discussed above, may rise to a "high" or one value at a first time 60, and may rise to a "high" or one value at a third time 64. The time 66 between first time 60 and third time 64 may be equal to a single refresh of the display 12. For example, the time 66 between first time 60 and third time 64 may be 16.6 ms, which corresponds to a 60 Hz refresh rate for display 12. Additionally, prior to third time 64, the vertical sync signal 88 may drop to a "low" or a zero value at time 88 and time 90. These drops may correspond to times when switching is occurring between, for example, the sampling driver circuitry 70 and 72. That is, during the "low" period of the vertical sync signal 88 (beginning at times 88 and 90) none of the pixels of the panel 42 are emanating light. Accordingly, by alteration of the OLED display 34 to include multiple sampling driver circuitries 70 and 72, generation of two periods of time in which none of the pixels of the panel 42 are emanating light may be accomplished. That is, the panel 42 will be effectively off at twice the refresh rate of the display. Furthermore, when additional sampling driver circuitry is utilized (e.g., three sampling driver circuits), the panel will be effectively off at a number equal to the number of sampling driver circuits utilized (i.e., three times the refresh rate of the display when three sampling driver circuits are utilized, four times the refresh rate of the display when four sampling driver circuits are utilized, etc.) Additionally, the location of for example, time 88 may be altered based on the respective size of the sampling driver circuitry 70 in relation to the size of the sampling driver circuitry 72. For example, when the sampling driver circuitry 70 is larger (drives more pixels) than the sampling driver circuitry 72, time 88 will occur closer to time 64, while when the sampling driver circuitry 70 is smaller (drives fewer pixels) than the sampling driver circuitry 72, time 88 will occur closer to time 60. This movement of time 88 on vertical sync signal 88 is directly proportional to the size differential between the sampling driver circuitry 70 and the sampling driver circuitry 72 (or, similarly the size differential between the emission driver circuitry 74 and the emission driver circuitry 76, since the size and number of elements should be equal between the sampling driver circuitry 70 and the sampling driver circuitry 72 and emission driver circuitry 74 and the emission driver circuitry 76).

However, while the addition of multiple sampling driver circuitry and emission driver circuitry 74 illustrates one technique for increasing the number of times an OLED display is in an off state, other techniques for increasing the number of times an OLED display is in an off state may be utilized. For example, the display 12 of FIG. 5 may be utilized, however the signals sent to the panel 42 therein may be altered with respect to the previous discussion of FIG. 5.

Figure 9:
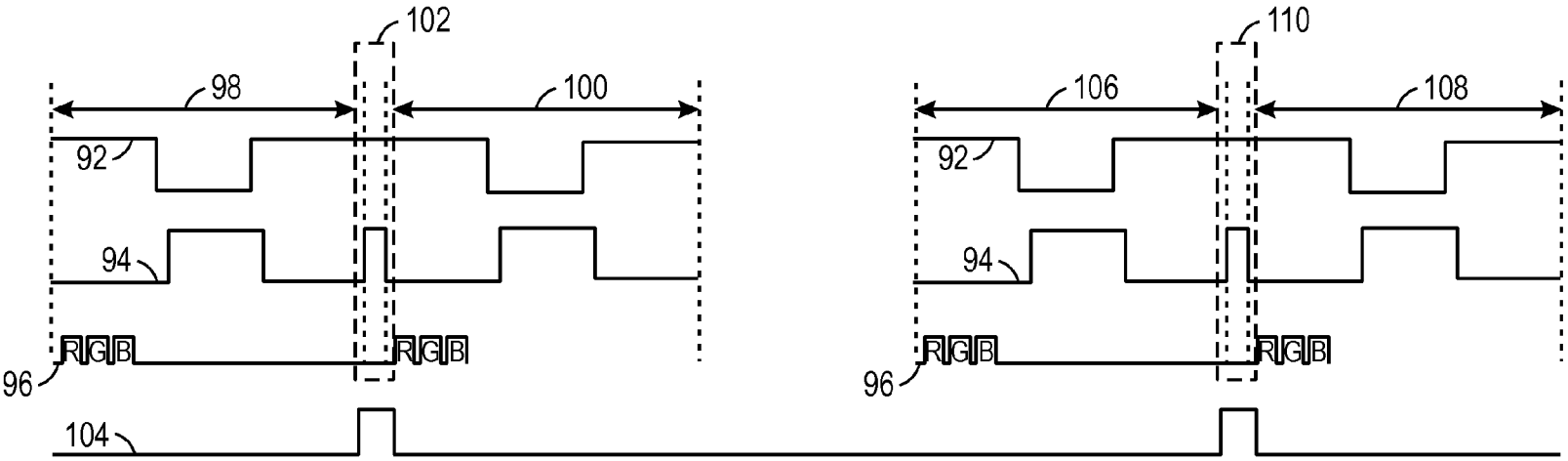
FIG. 9 depicts a second timing diagram for the operation of the circuitry of FIG. 5, in accordance with aspects of the present disclosure.

FIG. 9 illustrates a timing FIG. 8 illustrates a timing diagram related to the operation of the OLED display 34 of FIG. 5. As illustrated, waveform 92 corresponds to a sampling signal provided from the IC driver 44 to sampling driver circuitry 46 along path 54, waveform 94 corresponds to an emission signal provided from the IC driver 44 to emission driver circuitry 48 along path 56, and waveform 96 corresponds to the data shifted to red, green, and blue subpixels of a pixel in a pixel line. Period 98 may correspond to a single refresh or write cycle of an Nth line of pixels in panel 42, where both the sampling signal and the emission signal are active low. Thus, as illustrated, when the sampling signal goes active (low), the emission of that line of the panel is turned off in a trailing manner (e.g., the emission waveform 94 goes high subsequent to the sampling waveform 92 going active low). When the sampling signal then transitions to active high (when no more data is to be written to the pixels of the Nth line), the emission of that line of the panel is turned on in a trailing manner (e.g., the emission waveform 94 goes active low subsequent to the sampling waveform 92 going high).

Instead of this process being immediately repeated for the Nth+1 line in period 100, a panel deactivation signal process may be implemented. This panel activation process may include the IC driver 44 providing an emission signal to the emission driver circuitry 48 that causes all lines in the panel 42 to halt emissions. This is represented by period 102. That is, the IC driver 44 may insert an extra set of instructions (e.g., emission halt value) in the emission signal to be executed during period 102. During this time, all pixels in the panel 42 will be off (not emitting), as illustrated by waveform 104 (which illustrates the emission of the panel 42 as an active low waveform). Subsequent to period 102, period 100 may be undertaken for pixel line N+1 in a manner consistent with period 98.

Additionally, this process may be repeatable. For example, period 106 may correspond to a time subsequent to period 100 in which line M is being refreshed or written to (where M>N). Again, prior to period 102 in which line M+1 is to be refreshed or written to being immediately after period 106, the panel deactivation signal process may be implemented again. Again, the panel activation process may include the IC driver 44 providing an emission signal to the emission driver circuitry 48 that causes all lines in the panel 42 to halt emissions. This is represented by period 110. That is, the IC driver 44 may insert an extra set of instructions (e.g., emission halt value) in the emission signal to be executed during period 110. During this time, all pixels in the panel 42 will be off (not emitting), as illustrated by waveform 104 (which illustrates the emission of the panel 42 as an active low waveform). Subsequent to period 110, period 108 may be undertaken for pixel line M+1 in a manner consistent with period 106.

In this manner, the IC driver 44 may operate to insert specific instances of when the OLED display 34 of FIG. 5 should be turned off. This process may be done as required by the electronic device (e.g., in response to a request from one or more of the components of device 10) or on a preset schedule, so that any function that would benefit from being executed while the OLED display 34 is off may be scheduled accordingly.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A display comprising:

a display panel comprising an array of pixels;

first driver circuitry configured to transmit data values corresponding to an image to be displayed on the display to a first set of pixels in the array of pixels;

second driver circuitry configured to transmit second data values corresponding to an image to be displayed on the display to a second set of pixels in the array of pixels, wherein a number of pixels in the first set of pixels differs from a number of pixels in the second set of pixels;

third driver circuitry configured to activate and deactivate emission of light from each of the pixels of the first set of pixels; and fourth driver circuitry configured to activate and deactivate the emission of light from each of the pixels of the second set of pixels, wherein a size differential between the first driver circuitry and the second driver circuitry is selected to be directly proportional to a start time of a predetermined time period during a refresh period of the display panel when none of the array of pixels is emanating light.

2. The display of claim 1, comprising a panel driver configured to generate and transmit data signals independently to each of the first driver circuitry and the second driver circuitry.

3. The display of claim 2, wherein the panel driver is configured to generate and transmit emission signals independently to each of the third driver circuitry and the fourth driver circuitry.

4. The display of claim 1, wherein the predetermined time period corresponds to a vertical synch signal occurring during the refresh period of the display panel.

5. The display of claim 1, comprising:

fifth driver circuitry configured to transmit data values corresponding to an image to be displayed on the display to a third set of pixels in the array of pixels; and sixth driver circuitry configured to activate and deactivate the emission of light from each of the pixels of the third set of pixels.

* * * * *